United States Patent [19]

Sokoly et al.

[11] 4,272,411

[45] Jun. 9, 1981

[54] METAL OXIDE VARISTOR AND METHOD

[75] Inventors: Theodore O. Sokoly, Racine; John Niedzialkowski, Milwaukee, both of Wis.

[73] Assignee: Electric Power Research Institute, Palo Alto, Calif.

[21] Appl. No.: 18,626

[22] Filed: Mar. 8, 1979

[51] Int. Cl.[3] ..... H01B 1/04

[52] U.S. Cl. ..... 252/516; 252/518; 252/519; 264/61; 264/104; 338/20

[58] Field of Search ..... 252/516, 518, 519; 264/104, 61, DIG. 25; 338/20, 21

[56] References Cited

U.S. PATENT DOCUMENTS

| | | | |
|---|---|---|---|
| 3,380,936 | 4/1968 | Masuyama et al. | 252/516 |
| 3,788,997 | 1/1974 | MacKenzie | 252/516 |
| 3,928,245 | 12/1975 | Fishman et al. | 252/518 |
| 3,938,069 | 2/1976 | May | 252/518 |
| 3,953,373 | 4/1976 | Matsumura et al. | 252/518 |
| 3,959,543 | 5/1976 | Ellis | 252/518 |
| 4,003,855 | 1/1977 | Wong | 252/518 |
| 4,046,847 | 9/1977 | Kresge | 252/518 |
| 4,169,071 | 9/1979 | Eda et al. | 252/518 |
| 4,180,483 | 12/1979 | Ho et al. | 252/518 |
| 4,184,984 | 1/1980 | Levinson | 252/518 |

*Primary Examiner*—Deborah L. Kyle
*Assistant Examiner*—J. L. Barr
*Attorney, Agent, or Firm*—Flehr, Hohbach, Test

[57] ABSTRACT

A composition is provided for use in forming varistor blocks containing mostly zinc oxide together with other impurities, including significant amounts of silicon carbide to a concentration of less than one molar percent of the total varistor composition. The method of forming varistor blocks according to the invention includes mixing zinc oxide powder together with the silicon carbide and other impurities, and then sintering the mixture at a temperature in the range of from approximately 1100° C. to approximately 1250° C.

11 Claims, 5 Drawing Figures

METAL OXIDE VARISTOR AND METHOD

BACKGROUND OF THE INVENTION

The invention relates generally to metal oxide non-linear resistors known as varistors, and more particularly to compositions for forming varistor blocks containing mostly zinc oxide.

One important use of varistors is in overvoltage protection devices for power transmission and distribution lines. Connected between a high voltage line and ground, the varistors are essentially non-conducting below predetermined breakover voltage level. When the breakover voltage of the varistor is exceeded, there is a sharp rise in current through the device. Ideally, after breakover a varistor will pass current to the extent necessary to prevent any further increase in voltage. The non-linear voltage-dependent resistance of varistors enables them to effectively protect against overvoltages on power lines caused by lightning bolts or the like.

Varistors comprise a sintered body having metal contacts on opposed faces. Operating parameters are measured in several ways. One measure of the breakover voltage of a varistor is termed the one milliamp voltage (1 mA V), which is the voltage per centimeter of thickness when the device is conducting current at a density of 1 mA per square centimeter. Device linearity is evaluated by determining the changes in voltage at increasing current levels. One measure of linearity is termed the voltage ratio, which is the voltage per centimeter of thickness across the device at a current density of 75 amps per square centimeter, divided by the 1 mA voltage. Another measure of varistor performance is surge durability, which is determined by the decrease in the 1 mA voltage after a large current (for example, 500 amps per square centimeter) has been passed through the device. Surge durability measures the resistance of the device to current channeling in the varistor body under severe loading conditions.

Various compositions are used in forming varistor bodies. Prior art varistors containing mostly silicon carbide are well known. More recently, metal oxide varistors have been developed which offer superior performances, particularly in power line overvoltage applications. The varistor bodies in such metal oxide varistors commonly are composed mostly of zinc oxide. Examples of such varistors are disclosed in U.S. Pat. Nos. 3,928,245 and 3,953,373.

In view of the ever increasing voltages employed on power transmission and distribution lines, there is a continuing need in the electric power industry for improved overvoltage protection devices. On high voltage lines, for example, it is necessary to employ numerous varistors in series. The varistors used must therefore have both good surge durability and linearity if they are to be economically practical.

OBJECTS AND SUMMARY OF THE INVENTION

It is the general object of the present invention to provide a varistor composition having improved durability.

It is another object of the present invention to provide a varistor composition having an improved voltage ratio.

Another object of the present invention is to provide a method of forming a varistor body from a mixture containing mostly zinc oxide which includes silicon carbide as an impurity.

Accordingly, a method of forming a varistor body is provided, including the initial step of mixing zinc oxide powder with impurities which include silicon carbide. The resultant mixture is then sintered at a temperature in the range of from approximately 1100° C. to approximately 1250° C. to form a substantially solid varistor body. The resultant sintered varistor body comprises zinc oxide together with a relatively small amount of impurities. The impurities include silicon carbide to a concentration of from 0.01 to 1.0 molar percent of the varistor body.

DESCRIPTION OF THE PREFERRED EMBODIMENT

Figure 1:
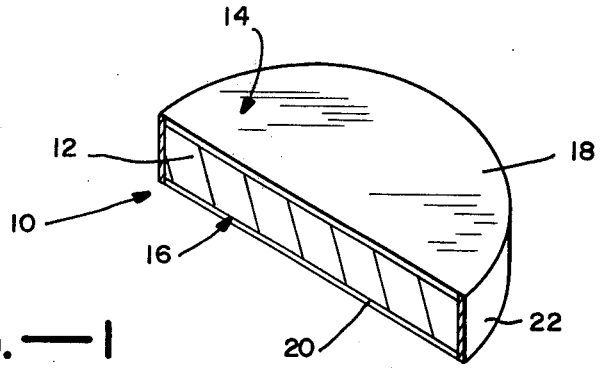
FIG. 1 shows a sectioned perspective view of a varistor having a varistor body according to the present invention.

A varistor according to the present invention is shown in FIG. 1. The varistor 10 assumes the shape of a disc having a sintered body 12 formed of zinc oxide together with a relatively small amount of certain impurities described below. Body 12 has a pair of opposed substantially flat faces 14 and 16 on which are provided metal contacts 18 and 20, respectively. Extending around the perimeter of body 12 is an antiflashover collar 22, preferably comprising a coating of insulating material.

Figure 2:
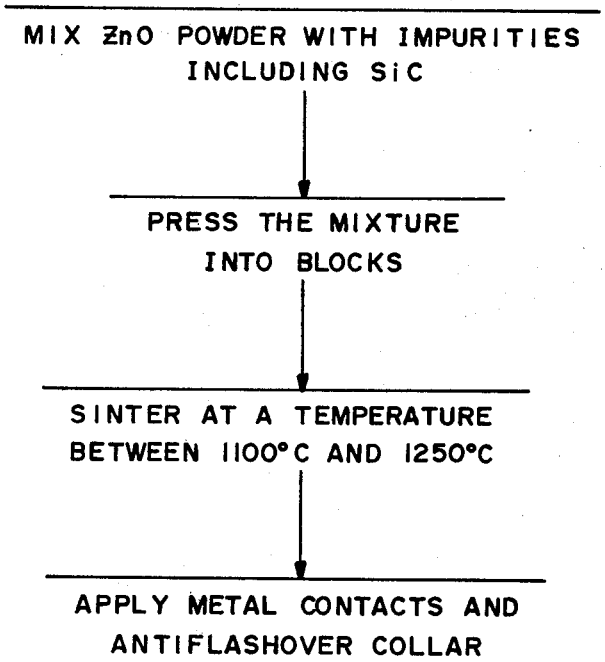
FIG. 2 is a flow diagram illustrating the steps in forming the varistor of FIG. 1.

The method of forming varistor 10 is illustrated in FIG. 2. Varistor body 12 is formed first by mixing zinc oxide (ZnO) powder together with impurities selected from the group consisting of bismuth trioxide ($Bi_2O_3$), maganese oxide (MnO), cobalt tetraoxide ($Co_3O_4$), nickel oxide (NiO), and antimony trioxide ($Sb_2O_3$). In addition, the mixture contains silicon carbide (SiC) as an impurity to a concentration of from 0.1 to 1.0 molar percent. Zinc oxide should form at least ninety molar percent of the final mixture.

A preferred mixture for forming a varistor body according to the invention contains the following:

at least 92.7 molar percent ZnO
2.5 molar percent $Bi_2O_3$
0.4 molar percent MnO
1.1 molar percent $Co_3O_4$
0.8 molar percent NiO
1.5 molar percent $Sb_2O_3$
between 0.01 and 1.0 molar percent SiC The above mixture is pressed into the shape of a disc, which is then sintered at a temperature between 1100° C. and 1250° C., forming a substantially solid varistor body. The sintering step preferably proceeds for approximately one hour.

After sintering, faces 14 and 16 are coated with conductive metal to form contacts 18 and 20, respectively. Suitable metals for the contacts include zinc, copper, aluminum, silver, and alloys of zinc and copper. A suitable antiflashover collar 22 is also added around the circumference of body 12. Collar 22 is preferably formed of a glass compound or another suitable insulating material applied in any conventional manner.

The addition of a significant amount of silicon carbide as an impurity to the mostly zinc oxide varistor material has been found to significantly improve the performance of the resulting varistor. Heretofore silicon carbide has only been used as an abrasive in lapping metal oxide varistor blocks, or as the almost sole ingredient in silicon carbide varistors. Here, silicon carbide is used as an impurity, in varying amounts, to improve the performance of zinc oxide varistors.

Figure 3:
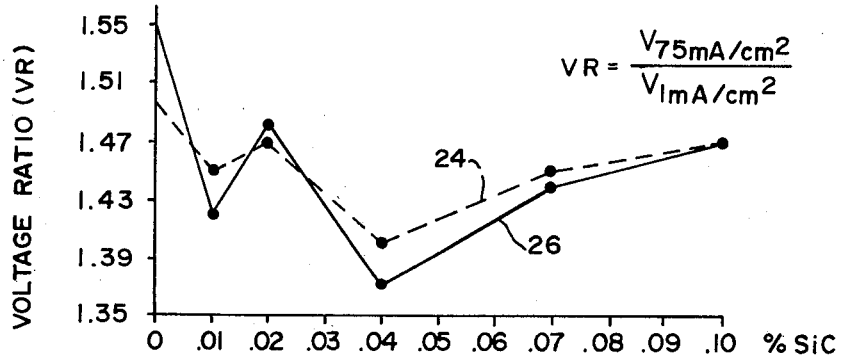
FIG. 3 is a plot of the voltage ratio of a varistor according to the invention as a function of the percentage of silicon carbide impurity in the varistor body.

FIG. 3 illustrates the effect on the voltage ratio of adding silicon carbide to a zinc oxide varistor containing the additional impurities in the concentrations described above. As defined in the "Background" above, the voltage ratio is the voltage across the device at a current density of 75 amps/cm$^2$ divided by the voltage at one milliamp/cm$^2$ density. In an ideal varistor the voltage ratio would be 1.00, meaning the voltage does not increase with current. In FIG. 3, plots 24 and 26 record the change in the voltage ratio as a function of SiC concentration for varistors sintered for one hour at 1150° C. and 1175° C., respectively. Note that the voltage ratio is lower for all varistors having some silicon carbide impurity than for varistors containing no silicon carbide. Of particular interest is the significant drop in the voltage ratio evident in varistors having silicon carbide impurity at a concentration of 0.04 molar percent. Although the test varistors were prepared by sintering at temperatures of 1150° C. and 1175° C., those temperatures are not critical to the invention.

Figure 4:
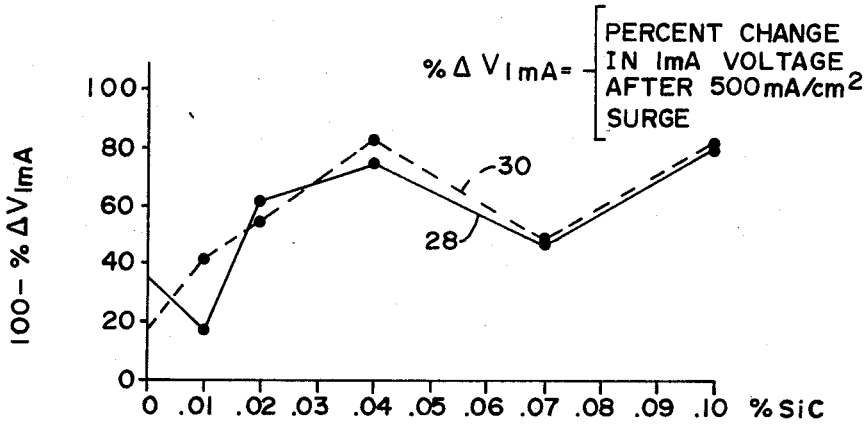
FIG. 4 is a plot of the surge durability of a varistor according to the invention as a function of the percentage of silicon carbide impurity in the varistor body.

FIG. 4 illustrates the change in surge durability for varistors having the previously-described impurity concentrations as a function of silicon carbide concentration. The test of surge durability involves first determining the 1 mA voltage of the varistor and then subjecting it to a conventional surge waveform of 10×20 microseconds duration having peak current density of 500 amps/cm$^2$. Finally, the 1 mA voltage is again determined. The reduction in the 1 mA voltage produced by the surge waveform provides a measure of varistor durability under typical operating conditions. In FIG. 4, plots 28 and 30 record the percentage change in the 1 mA voltage for varistors sintered for one hour at 1150° C. and 1175° C., respectively. There is a significant improvement in surge durability for varistors having silicon carbide impurity at a concentration of 0.04 molar percent. Moreover, some improvement is evident for all silicon carbide concentrations above 0.01 molar percent.

Figure 5:
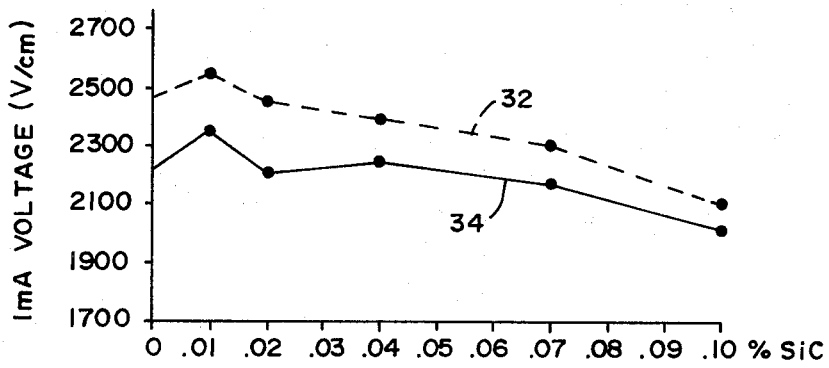
FIG. 5 is a plot of the 1 milliamp voltage of a varistor according to the invention as a function of the percentage of silicon carbide impurity in the varistor body.

FIG. 5 illustrates the effect on the 1 mA voltage of varying concentrations of silicon carbide between 0 and 0.1 molar percent. Plots 32 and 34 show the 1 mA voltage for varistors sintered for one hour at temperatures of 1150° C. and 1175° C., respectively. As shown, there is some small decrease in the 1 mA voltage with increasing concentrations of silicon carbide.

The test results illustrated in FIGS. 3–5 show that the addition of small amounts of silicon carbide as in impurity in a predominantly zinc oxide varistor yields improved surge durability and voltage ratio performance without significantly reducing the 1 mA voltage. Silicon carbide is both abundant and inexpensive and thus provides an extremely advantageous impurity for use in metal oxide varistors. Although the precise concentration limits for the advantageous use of silicon carbide as an impurity have not been determined, it appears at present that concentrations of up to 1 molar percent SiC are beneficial. Because of the improved voltage ration and durability of varistors formed according the present invention, they are particularly advantageous for use in high voltage surge arrestors where numerous varistors are employed in series. At present, the most advantageous concentration of silicon carbide as an impurity in zinc oxide varistors of the type described above appears to be 0.04 molar percent.

Other varistor compositions are possible within the scope of the invention. The concentrations listed above for impurities other than silicon carbide are illustrative only. Moreover, the precise percentages listed for the impurities other than silicon carbide are those of the mixture before sintering. It is known that some of the elements will be partially lost by evaporation in the heating process. For example, the final varistor body after sintering will most likely have a reduced concentration of bismuth.

A method has been described for producing metal oxide varistors having improved durability and linearity. The invention employs silicon carbide as an impurity in the varistor composition.

What is claimed is:

1. A sintered body for a varistor having the following composition by weight:

92.7–93.69 molar percent zinc oxide
2.50 molar percent bismuth trioxide
0.40 molar percent manganese oxide
1.10 molar percent cobalt tetraoxide
0.80 molar percent nickel oxide 1.50 molar percent antimony trioxide, and
0.01–1.00 molar percent silicon carbide

2. A sintered body as in claim 1 wherein said composition includes 0.04 molar percent silicon carbide and 93.66 molar percent zinc oxide.

3. A method of forming a varistor body comprising the steps of: mixing zinc oxide powder with impurities including silicon carbide to form a predetermined mixture, and sintering said mixture at a temperature in the range of from approximately 1100° C. to approximately 1250° C. to form a substantially solid varistor body, said mixture having the following composition by weight:

92.7–93.69 zinc oxide
2.50 percent bismuth trioxide
0.40 percent maganese oxide
1.10 percent cobalt tetraoxide
0.80 percent nickel oxide
1.50 percent antimony trioxide, and
0.01–1.00 percent silicon carbide

4. A method as in claim 3 wherein said composition includes 0.04 molar percent silicon carbide and 93.66 molar percent zinc oxide.

5. A method of forming a varistor body comprising the steps of: mixing zinc oxide powder with impurities including silicon carbide to form a mixture containing at least ninety molar percent zinc oxide and from 0.01 to 1.0 molar percent silicon carbide, and sintering said mixture at a temperature in the range of from approximately 1100° C. to approximately 1250° C. to form a substantially solid varistor body.

6. A method as in claim 5 in which said mixing step includes mixing zinc oxide powder and silicon carbide together with additional impurities selected from a group consisting of bismuth trioxide, manganese oxide, cobalt tetraoxide, nickel oxide, and antimony trioxide.

7. A method as in claim 5 in which said mixture formed in said mixing step includes approximately 0.04 molar percent silicon carbide.

8. A method as in claim 5 in which said mixing step includes forming a mixture having the following composition by weight:

93.66 percent zinc oxide
2.50 percent bismuth trioxide
0.40 percent manganese oxide
1.10 percent cobalt tetraoxide
0.80 percent nickel oxide
1.50 percent antimony trioxide, and
0.04 percent silicon carbide.

9. A method as in claim 5 in which said mixture is sintered for approximately one hour.

10. In a varistor having a sintered body including at least 90 molar percent zinc oxide and a number of impurities in relatively small amounts mixed therewith, the improvement comprising the inclusion of silicon carbide as one of said impurities in an amount sufficient to improve the voltage ratio and surge durability characteristics of said varistor, substantially without a reduction in its one milliamp voltage characteristic.

11. The improvement according to claim 10 wherein between about 0.01 and 1.00 molar percent silicon carbide is included as one of said impurities.

* * * * *